US005813070A

United States Patent [19]

Dittrich

[11] Patent Number: 5,813,070

[45] Date of Patent: Sep. 29, 1998

[54] CHORD SECTION ARRANGEMENT WITH LOWER CHORD WITH INTEGRATED GUIDE GROOVE OF A BRIDGE SECTION THAT CAN BE LAID MECHANICALLY

[75] Inventor: Helmut Dittrich, Ginsheim-Gustavsburg, Germany

[73] Assignee: Man Technologie AG, Augsburg, Germany

[21] Appl. No.: 629,374

[22] Filed: Apr. 8, 1996

[30] Foreign Application Priority Data

May 17, 1995 [DE] Germany ..... 295 08 133 U

[51] Int. Cl.[6] ..... E01D 15/133

[52] U.S. Cl. ..... 14/2.4; 14/74.5

[58] Field of Search ..... 14/2.4, 2.5, 73, 14/74.5, 77.1, 78

[56] References Cited

FOREIGN PATENT DOCUMENTS 94 15 420.1 2/1995 Germany .

295 07 445.0 5/1995 Germany .

*Primary Examiner*—James Lisehora

*Attorney, Agent, or Firm*—McGlew and Tuttle

[57] ABSTRACT

A bridge section made of light metal including a vertical web, an upper chord section connected to an upper end of the vertical web and a lower chord section connected to a lower end of the vertical web. The upper chord includes a thick-walled horizontal part with a weld seam connection and a thin-walled flange. The thin-walled flange has a wall thickness which is less than the thick-walled horizontal part. The vertical web has a wall thickness which is greater than the thin-walled horizontal part and the lower chord has a wall thickness which is greater than the thin-walled horizontal part. A residual wall is formed by machining the lower chord section and the vertical web over a length area. The residual wall has a residual wall thickness with two planes arranged at right angles to one another over the length area. A T-shaped insert is provided including two legs. A connection device is provided for connecting the two legs of the T-shaped insert to the residual wall portions.

13 Claims, 5 Drawing Sheets

CHORD SECTION ARRANGEMENT WITH LOWER CHORD WITH INTEGRATED GUIDE GROOVE OF A BRIDGE SECTION THAT CAN BE LAID MECHANICALLY

FIELD OF THE INVENTION

Lower chord section with a hollow cross section which is closed in itself, with an integrated guide groove, as well as with one or more web wall connections of a bridge section made of light metal, as well as with two sections welded together at right angles or with an open I-shaped section cross section, with an integrated guide groove, as well as with a thick-walled, vertical web, with an upper, thin-walled, horizontal flange, with an upper, thick-walled, horizontal part with a weld seam connection, and with a lower, thick-walled part.

BACKGROUND OF THE INVENTION

In bridges which can be laid mechanically and have a lower chord section with integrated guide groove, the lower part of the guide groove may be damaged due to an incorrect laying process or due to unfavorable support of the bridge.

Since the intrinsic weight of a bridge which can be laid mechanically is kept as low as possible, the lower chord section is also designed only with wall thicknesses as are statically required.

Repairs on damaged areas are therefore not always possible if the material must be subsequently subjected to heat treatment for a defined period of time in a temperature range to be strictly observed, e.g., after a welding in order to approximately reach the necessary strength values.

In a guide groove known from DE-GM 94 15 420.1 on the lower wall section of a lower chord of a bridge section, part of the vertical wall arrangement of the lower wall section is removed by machining after damage to the guide groove, especially the lower wall section, and the guide groove is again complemented by an L-shaped angle section bolted on.

Such a restoration of a damaged guide groove of a lower chord requires that this lower chord section of a bridge section have a vertical wall arrangement with larger cross section in the damaged area than in the rest of the bridge to ensure reliable fastening of the L-shaped angle section after the machining.

After the machining, e.g., after milling out of the damaged area, sufficient material is available from this lower chord section for the fastening of the L-shaped angle section only in the area of the vertical wall arrangement, and the purposeful bonding of the repaired guide groove in the cross section of the lower chord section is thus not guaranteed.

GM 295 07 445.0, which is the only document registered at present, discloses a guide groove on the lower wall section of a lower chord of bridge sections with a hollow cross section which is closed in itself or with an open I-section and with upper and lower wall sections originating from a vertical wall arrangement, wherein a part of the guide groove was removed from the lower chord in the longitudinal direction by machining as part of the lower wall section and as part of the vertical wall arrangement.

Not only does this embodiment offer the possibility of repairing the damaged lower chord section, but it is also possible to use an extruded section made of light metal, which can be manufactured at a favorable cost, in the case of new lower chord sections.

The repaired cross section of the lower chord section comprises a welded-in shaped part and a T-shaped insert, which is fastened by its webs and legs on the shaped part by means of connection means. The common contact surfaces of the welded-in shaped part and of the T-shaped insert are dimensioned such that a minimum amount of machining may be carried out at a favorable cost.

SUMMARY AND OBJECTS OF THE INVENTION

The primary object of the present invention is to provide a hollow cross section which is closed in itself or an open I-section cross section with an integrated guide groove of a lower chord, in which the restoration of a perfectly integrated guide groove can be carried out at a low cost compared with the state of the art after damage to the lower part of the guide groove.

According to the invention, a bridge section made of light metal is provided including a chord section arrangement with a hollow cross section which is closed in itself, with an integrated guide groove as well as with one or more web wall connections, as well as with two chord sections welded together at right angles. The lower chord section includes a thick-walled vertical web and a lower, thick walled part. These are provided with a sufficient residual wall thickness after machining away a portion of the chord and the web to provide residual parts forming two planes arranged at right angles to one another over a length area to connect a key-shaped insert to the two legs by means of connection means in a dimensionally stable manner.

The key-shaped insert with its leg preferably has at least one pressure contact surface with the section on its front side. The thick-walled, vertical web and the lower, thick-walled part preferably have the respective wall thicknesses over the defined length area of the entire section after machining.

According to a further feature of the invention, a lower chord section with an open eye-shaped section cross section, with an integrated guide groove, as well as a thick-walled, vertical web, an upper, thin-walled, horizontal flange and with an upper, thick-walled horizontal part with a weld seam connection and with a lower, thick-walled part is provided. After the section has been locally machined, the thick-walled, vertical web and the lower, horizontal, thick-walled part of the lower chord section have a sufficient residual wall thickness with two planes arranged at right angles to one another over a length area to connect a T-shaped insert with its two legs by means of a connection means.

The T-shaped insert with its legs preferably has at least one pressure contact surface with respect to the section on its front side and the thick-walled, vertical web and the lower, thick-walled part have a wall thickness over a defined length area of the entire section after a local machining. The T-shaped insert preferably has one or more gravity securing means in the plane next to or between the connection means and the T-shaped insert preferably comprises the same material as the lower chord section or comprises a different material.

The design of a lower chord section with integrated guide groove of a hollow cross section which is closed in itself or with an open I-section cross section with a thick-walled, vertical web at the guide groove and with a lower, thick-walled, horizontal part offers the possibility of removing the damaged part of the guide groove by machining and to restore the shape of the guide groove with a spare part.

The spare part is designed in the known manner as a T-shaped insert, so that it can be fastened on the machined part of the lower chord in planes directed at right angles to one another by means of connection means. Any occurring load is transmitted to the T-shaped insert due to a positive-locking connection to the lower chord section.

Another advantage of the present invention is that the T-shaped insert preferably has the same type of material as the lower chord, so that the strength will not decrease in the repaired area of the lower chord. It is even possible to select for the T-shaped insert a material having such strength properties which material would not otherwise be able to be used for welding-technical reasons.

The intrinsic weight of the construction is increased only minimally due to the design of the lower chord according to the present invention and to the machining during the manufacture of a bridge section on the part of the lower chord where no damage to the guide groove is to be expected.

The welded lower chord section according to the present invention offers the possibility of providing the closed, box-shaped cross section in an area in which the transmission of the loads from the guide groove in the open lower chord cross section can no longer be sufficiently absorbed during the bridge-laying process.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
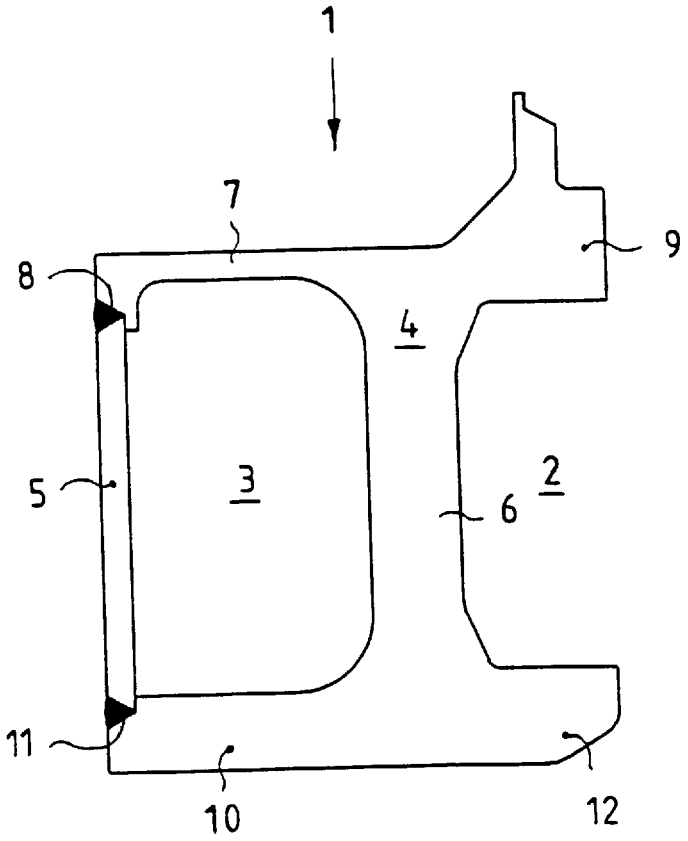
FIG. 1 is a schematic view of a closed, box-shaped lower chord cross section.

FIG. 1 shows a closed, box-shaped lower chord 1 with integrated guide groove 2 and with a closed, box-shaped cross section 3, which was formed by welding together from the open section 4 and a sheet metal element 5 in the area of the weld seam connections 8, 11.

The I-shaped section 4 having an open cross section comprises:

a thick-walled, vertical web 6, an upper, thin-walled, horizontal part 7 with a weld seam connection 8, another upper, thick-walled, horizontal part 9 having a weld seam connection region, a lower, thick-walled part 10 with the weld seam connection 11, and a lower, thick-walled part 12.

Figure 2:
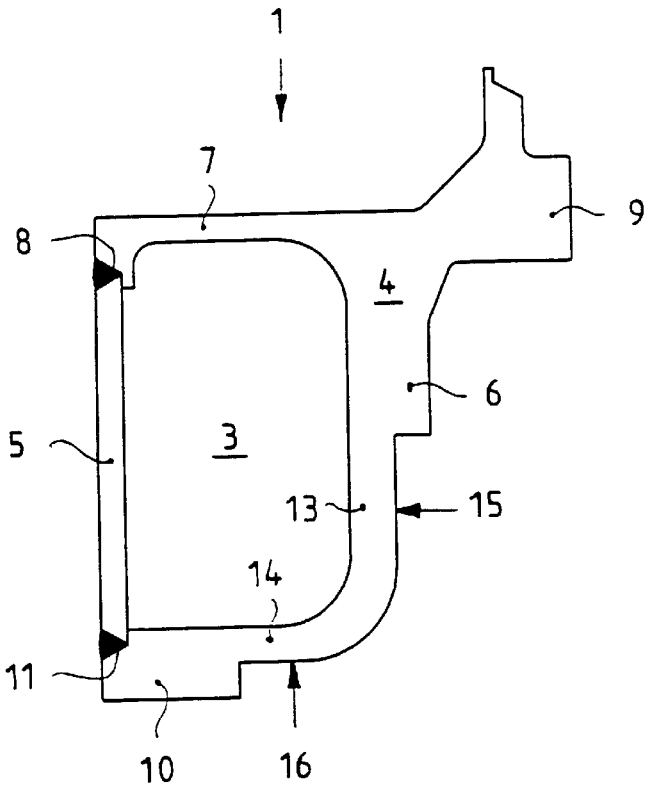
FIG. 2 is a schematic view of a closed, boxed-shaped lower chord cross section after the machining.

FIG. 2 shows that in a closed, box-shaped lower chord section 1 corresponding to FIG. 1, the thick-walled, vertical web 6 and the lower, thick-walled part 10 have a sufficient residual wall thickness 13, 14 with two planes 15, 16 arranged at right angles to one another after machining.

Figure 3:
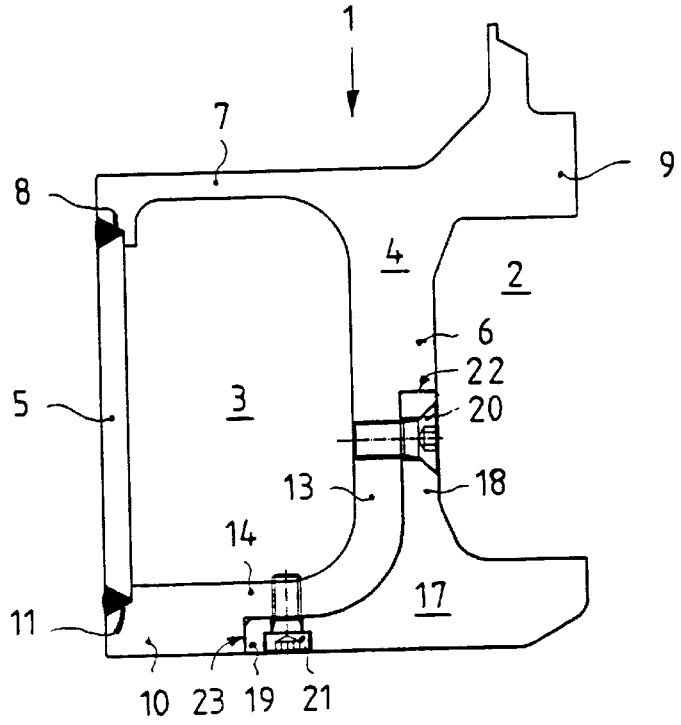
FIG. 3 is a schematic view of a closed, box-shaped lower chord cross section with T-shaped insert.

FIG. 3 shows the closed, box-shaped lower chord section 1 corresponding to FIG. 2 with an integrated, T-shaped insert 17, which is connected with its two legs 18, 19 to the machined parts 13, 14 by means of connection means 20, 21, wherein the T-shaped insert 17 with its legs 18, 19 has pressure contact surfaces 22, 23 against the section 4. Connection means 20 forms a shearing force securing means.

Figure 4:
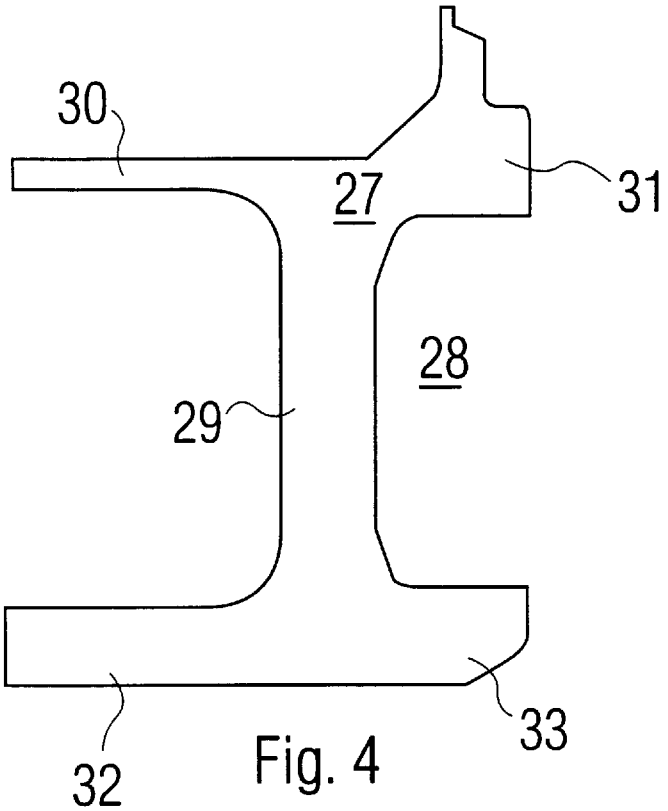
FIG. 4 is a schematic view of an open, I-shaped lower chord cross section.

The open, I-shaped lower chord section 27 with integrated guide groove 28 shown in FIG. 4 comprises a thick-walled, vertical web 29, an upper, thin-walled, horizontal part 30, an upper, thick-walled, horizontal part 31, a lower, thick-walled part 32, and a lower, thick-walled part 33.

Figure 5:
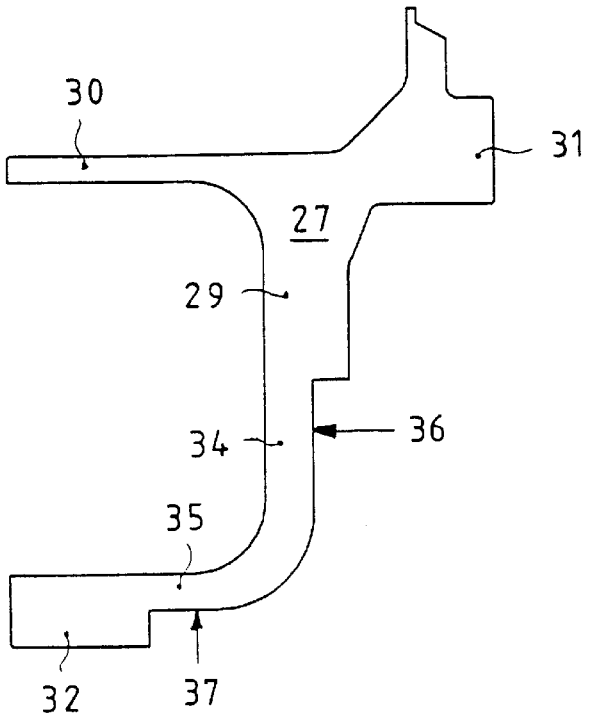
FIG. 5 is a schematic view of an open, I-shaped lower chord cross section after machining.

As can be recognized from FIG. 5, the thick-walled, vertical web 29 and the lower, thick-walled part 32 in an open-I-shaped lower chord section 27 have a sufficient residual wall thickness 34, 35 with two planes 36, 37 arranged at right angles to one another after machining.

Figure 6:
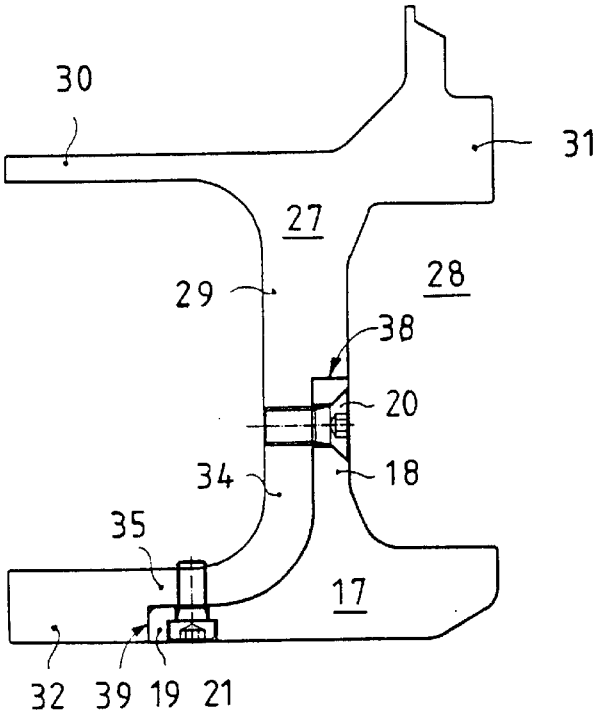
FIG. 6 is a schematic view of an open, I-shaped lower chord cross section with T-shaped insert.

FIG. 6 shows an open, I-shaped lower chord section 27 corresponding to FIG. 5 with a T-shaped insert 17, which is connected with its two legs 18, 19 to the residual wall thicknesses 34, 35 of the machined parts by means of connection means 20, 21, wherein the T-shaped insert 17 with its legs 18, 19 has pressure contact surfaces 38, 39 against the section 27 on the front side.

Figure 7:
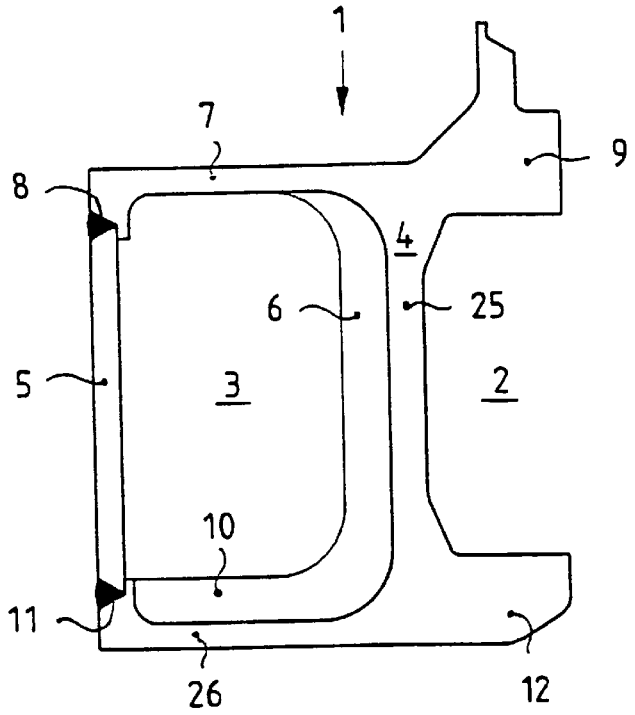
FIG. 7 is a schematic view of a closed, box-shaped lower chord cross section with machined inner surfaces.

FIG. 7 shows that in a closed lower chord section 1 corresponding to FIG. 1, the thick-walled web 6 and the lower, thick-walled part 10 of the flange have a residual wall thickness 25, 26 over the section 4 for weight reduction after the machining.

Figure 8:
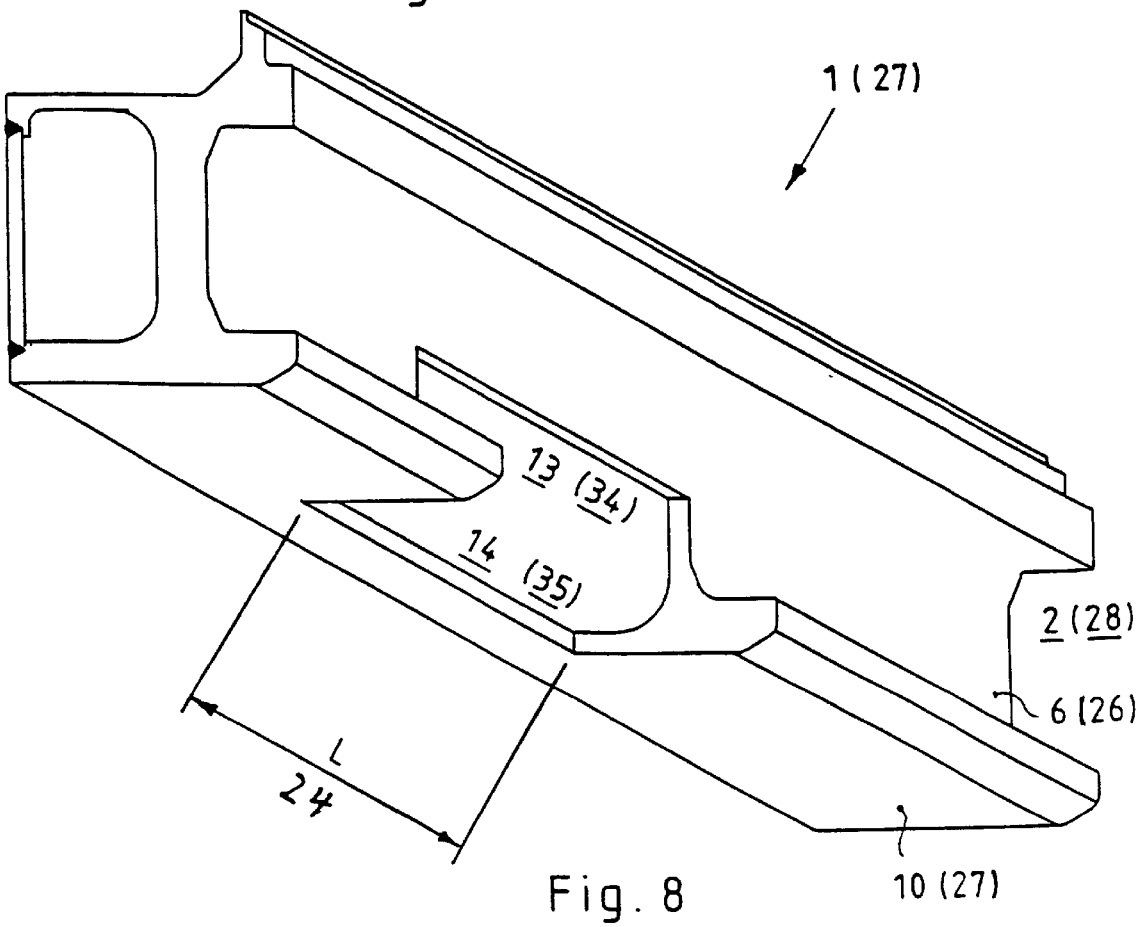
FIG. 8 is a schematic isometric view of a lower chord section with a damaged area removed by machining.

FIG. 8 shows an isometric view of a closed lower chord section 1, 27 corresponding to FIG. 1 with a guide groove 2, 28 and a damaged area of the length "L" 24 removed by machining and with the residual wall thicknesses 13, 34 and 14, 35 of the machined parts of the thick-walled web 6 and of the lower, thick-walled, horizontal part 10.

Figure 9:
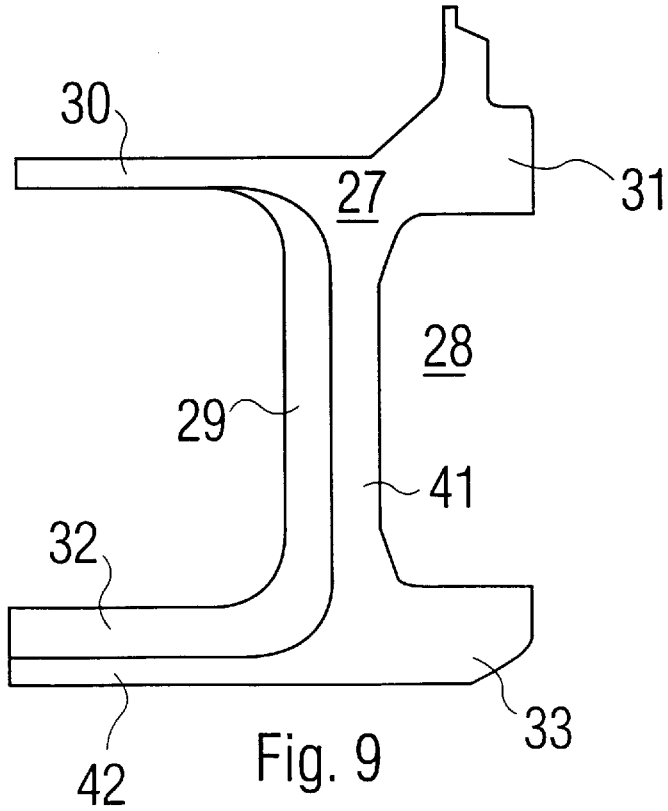
FIG. 9 is a schematic view of an open, I-shaped lower chord cross section with machined inner surfaces.

FIG. 9 shows an open, I-shaped lower chord section 27 corresponding to FIG. 4, in which parts of the thick-walled, vertical web 29 and of the lower, thick-walled, horizontal part 32 of the flange are reduced by machining the inner surfaces to a residual wall thickness 41, 42.

While specific embodiments of the invention have been shown and described in detail to illustrate the application of the principles of the invention, it will be understood that the invention may be embodied otherwise without departing from such principles.

List of Reference Numbers

1, 27 Lower chord
2, 28 Guide groove
3 Closed, box-shaped cross section
4 Open section
5 Sheet metal
6, 29 Thick-walled, vertical web
7, 30 Thin-walled, horizontal part

8 Weld seam connection
9, 31 Upper, thick-walled, horizontal part
10, 32 Lower, thick-walled, horizontal part
11 Weld seam connection
12 Lower, thick-walled part
13, 14, 34, 35 Residual wall thickness of the machined parts
15, 16, 36, 37 Plane
17 T-shaped insert
18, 19 Legs of 17
20, 21 Connection means
22, 23, 38, 39 Pressure contact surface
24 Machined length area "L"
25, 26, 41, 42 Residual wall thickness

What is claimed is:

1. A chord section arrangement of a bridge section made of light metal, the chord section comprising:

a thick-walled vertical web having a thick wall;

two chord sections connected to said vertical web, said two chord sections including a lower chord section with a thick wall; and an element welded to said chord sections at right angles to said chord sections to define a hollow cross section which is closed in itself, said vertical web and said lower chord section having a thick-walled part wherein a portion of each thick-walled part of said vertical web and said lower chord section is removed by machining leaving residual wall portions having a thickness smaller than said vertical web thick wall and smaller than said lower chord thick wall, said residual wall portions extending in two planes arranged at right angles to one another over a length area and defining a remaining vertical web portion with said thick wall and a remaining lower chord portion with said thick wall;

a T-shaped insert including two legs; and connection means for connecting said two legs to said residual wall thicknesses in a dimensionally stable manner between said remaining vertical web portion with said thick wall and a remaining lower chord portion with said thick wall.

2. A chord section arrangement according to claim 1, wherein said T-shaped insert includes at least one pressure contact surface for contact with a side of one of said vertical web and said wall part.

3. A chord section arrangement accord with claim 1, wherein said lower chord section includes a thick-walled part extending from said lower chord section residual wall thickness to an end of said lower chord, and said thick-walled vertical web includes a thick-walled part extending from said residual wall thickness to an upper end of said vertical web after machining.

4. A chord section arrangement according to claim 1, wherein connection means for connecting said two legs of said T-shaped insert to said residual wall portions includes an element connecting one of said legs to one of said residual wall portions and an element connecting another of said legs to another of said residual wall portions.

5. A chord section arrangement, comprising:

a thick-walled vertical web with a thick wall;

a thick walled lower chord connected to said vertical web, said lower chord having a thick wall;

an upper thin-walled horizontal flange with an upper thick-walled horizontal part with a weld seam connection region, said upper thin-walled horizontal flange being connected to said thick-walled vertical web, said vertical web, said lower chord and said horizontal flange forming an open I-shape section cross section including an integrated guide groove, each of said thick-walled vertical web and said thick walled lower chord being machined to form residual wall portions with a thickness smaller than said vertical web thick wall and smaller than said lower chord thick wall, said residual wall portions forming two planes arranged at right angles to one another over a length area and defining a remaining vertical web portion with said thick wall and a remaining lower chord portion with said thick wall;

a T-shaped insert including two legs; and connection means for connecting said two legs of said T-shaped insert to said residual wall portions, between said remaining vertical web portion with said thick wall and a remaining lower chord portion with said thick wall.

6. A chord section arrangement according to claim 5, wherein said T-shaped insert includes at least one pressure contact surface engaging a pressure contact surface side of said lower chord adjacent to said residual wall portions, said side being part of a horizontal thick-walled part of said remaining lower chord portion, said lower chord section having said side thickness over a length area from said side to an opposite chord end.

7. A chord section arrangement according to claim 5, wherein said connection means includes a shearing force securing means in one of said two planes, said shearing force securing means being disposed adjacent to or between said connection means and said T-shaped insert.

8. A chord section arrangement according to claim 7, wherein said shearing force securing means comprises the same material as said lower chord section.

9. A chord section arrangement according to claim 7, wherein said shearing force securing means comprises a different material from said lower chord section.

10. A chord section arrangement according to claim 5, wherein connection means for connecting said two legs of said T-shaped insert to said residual wall portions includes an element connecting one of said legs to one of said residual wall portions and an element connecting another of said legs to another of said residual wall portions.

11. A bridge section made of light metal, comprising:

a vertical web with a thick wall;

an upper chord section connected to an upper end of said vertical web;

a lower chord section connected to a lower end of said vertical web, said lower chord section having a thick wall, said upper chord section including a thick-walled horizontal part with a weld seam connection region and a thin-walled flange, said thin-walled flange having a wall thickness which is less than said thick-walled horizontal part, said thick wall of said vertical web having a wall thickness which is greater than said thin-walled horizontal part and said thick wall of said lower chord section having a wall thickness which is greater than said thin-walled horizontal part;

residual wall portions formed by machining said lower chord section and said vertical web over a length area, said residual wall having a residual wall thickness with two planes arranged at right angles to one another over said length area and defining a remaining vertical web portion with said thick wall and a remaining lower chord portion with said thick wall;

a T-shaped insert including two legs; and connection means for connecting said two legs of said T-shaped insert to said residual wall portions, between said remaining vertical web portion with said thick wall and a remaining lower chord portion with said thick wall.

12. A bridge section according to claim 11, further comprising a sheet metal portion welded to said lower chord section and to said flange, connecting said lower chord section to said flange to form a hollow cross section which is closed in itself.

13. A chord section arrangement according to claim 11, wherein connection means for connecting said two legs of said T-shaped insert to said residual wall portions includes an element connecting one of said legs to one of said residual wall portions and an element connecting another of said legs to another of said residual wall portions.

* * * * *